US007434887B1

(12) United States Patent
Hsien

(10) Patent No.: US 7,434,887 B1
(45) Date of Patent: Oct. 14, 2008

(54) STEPLESSLY HEIGHT-ADJUSTABLE ARMREST STRUCTURE

(76) Inventor: Feng-Tien Hsien, No. 55, Lane 373, Shin Sheng South Road, Ma Tou, Tainan Hsien (TW)

( * ) Notice: Subject to any disclaimer, the term of this patent is extended or adjusted under 35 U.S.C. 154(b) by 0 days.

(21) Appl. No.: 12/003,864

(22) Filed: Jan. 3, 2008

(51) Int. Cl.
*A47C 7/54* (2006.01)

(52) U.S. Cl. ..... 297/411.36

(58) Field of Classification Search ..... 297/411.36, 297/353

See application file for complete search history.

(56) References Cited

U.S. PATENT DOCUMENTS 3,194,187 A * 7/1965 Linder et al. ..... 108/146
4,632,458 A * 12/1986 Brown et al. ..... 297/353
4,951,995 A * 8/1990 Teppo et al. ..... 297/411.36
5,795,026 A * 8/1998 Dral et al. ..... 297/411.36
5,829,839 A * 11/1998 Wilkerson et al. ..... 297/411.36
6,132,001 A * 10/2000 Su ..... 297/411.36
6,533,355 B2 * 3/2003 Broekhuis et al. ..... 297/353

* cited by examiner

*Primary Examiner*—Anthony D Barfield
(74) *Attorney, Agent, or Firm*—Rosenberg, Klein & Lee

(57) ABSTRACT

A height-adjustable armrest includes a base securely joined a seat, a tube secured on the base, a rack on an inner side of the tube, and an armrest body inserted in the tube; a movable gear is fitted on the armrest body and engages the rack; the armrest body includes an immobilizing component, which is arranged above the movable gear, and can be moved up and down relative to the armrest body by means of a control member; the immobilizing component has an engaging toothed portion, and is spring-biased downwards to normally engage the movable gear, thus preventing the armrest body from moving accidentally; a co-moving rod is pivoted on the armrest body, and can be moved together with the immobilizing component so that the co-moving rod will engage the gear to help fix the armrest body when the immobilizing component is in the lower position to engage the gear.

2 Claims, 7 Drawing Sheets

STEPLESSLY HEIGHT-ADJUSTABLE ARMREST STRUCTURE

BACKGROUND OF THE INVENTION

1. Field of the Invention

The present invention relates to a steplessly height-adjustable armrest, more particularly one, which is structured in such a manner as not to move to a lower position accidentally when it is pressed.

2. Brief Description of the Prior Art

It is a major concern of chair manufacturers to provide more comfortable chairs to the consumers. The seats and backs of currently existing chairs are usually formed with a certain curvature according to ergonomics. And, certain kinds of chairs are equipped with armrests for sitters to comfortably rest their arms on, which are best adjustable in height to be suitable for different persons.

Referring to FIGS. 6 and 7, a currently existing height adjustable armrest 5 consists of a base 51, a fixed tube 52, and an armrest main part 54. The base 51 is securely joined to a seat, and the fixed tube 52 is securely joined to the base 51. A rack 53 is secured in the fixed tube 52. The armrest main part 54 is inserted in the fixed tube 52 in a movable manner, and an ornamental cover 55 is positioned around and joined to the armrest main part 54, and covers the fixed tube 52. The armrest main part 54 has a step-shaped portion 541. The cover 55 has a hole 551. A gear 56 is fitted on the main part 54 to engage the rack 52, and an immobilizing member 57 is arranged right above the gear 56, and up and down displaceable relative to the armrest main part 54. The immobilizing member 57 has a lower toothed portion 571, an upper rod part 572, and a step-shaped portion 573 adjoining the upper rod part 572. An elastic element 58 is positioned around the rod part 572 of the immobilizing member 57, and contacts the step-shaped portions 541 and 573 at upper and lower ends thereof respectively. An operating part 59 is securely joined to an upper end of the rod part 572 of the immobilizing member 57, and sticks out through the hole 551 of the ornamental cover 55. Therefore, the immobilizing member 57 is normally biased to a lower position to engage and immobilize the gear 56 by means of the elastic element 58, thus preventing the armrest main part 54 from moving accidentally.

When the user moves the operating part 59 so as to lift the immobilizing member 57, the immobilizing member 57 will disengage the gear 56; thus, the gear is free to rotate. Therefore, the armrest main part 54 can be moved to a new height with the gear 56 rolling on the rack 53 secured in the fixed tube 52. After the armrest 5 has been adjusted to a proper height, and the user released the operating part 59, the immobilizing member 57 will be biased back to the lower position to engage the gear 56 by the elastic element 58; thus, the armrest main part 54 is fixed in position.

The above adjustable armrest is found to have a drawback: because the immobilizing member is kept in the lower position to engage the gear by means of the elastic element, the immobilizing member and the gear can get out of engagement easily if the sitter stands up with his/her hands pressing the armrest main part. Consequently, the armrest main part will be moved down accidentally, and the sitter can get hurt. Therefore, such an armrest is neither safe nor convenient to use.

Therefore, it is a main object of the present invention to provide an improvement on a steplessly height-adjustable armrest structure to overcome the above problem.

SUMMARY OF THE INVENTION

A height-adjustable armrest according to an embodiment of the present invention includes a base securely joined a seat, a fixed tube secured on the base, a rack on an inner side of the fixed tube, and an armrest body inserted in the fixed tube; a movable gear is fitted on the armrest body and engages the rack; an immovable gear is fixed near to the movable gear on the armrest body; the armrest body includes an immobilizing component, which is arranged above both the gears, and can be moved up and down relative to the armrest body by means of a control member; the immobilizing component has an engaging toothed portion, and is spring-biased downwards to normally engage both the gears at the toothed portion, thus preventing the armrest body from moving accidentally; a co-moving rod is pivoted at a middle portion on the armrest body, and pivoted at one end to a connecting piece joined to a lower end of the immobilizing component so that the co-moving rod will engage the gear at the other end to help fix the armrest body when the immobilizing member is in the lower position to engage the gear. Therefore, after height adjustment, the armrest body can be firmly fixed in position without the risk of being depressed to cause accidents.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
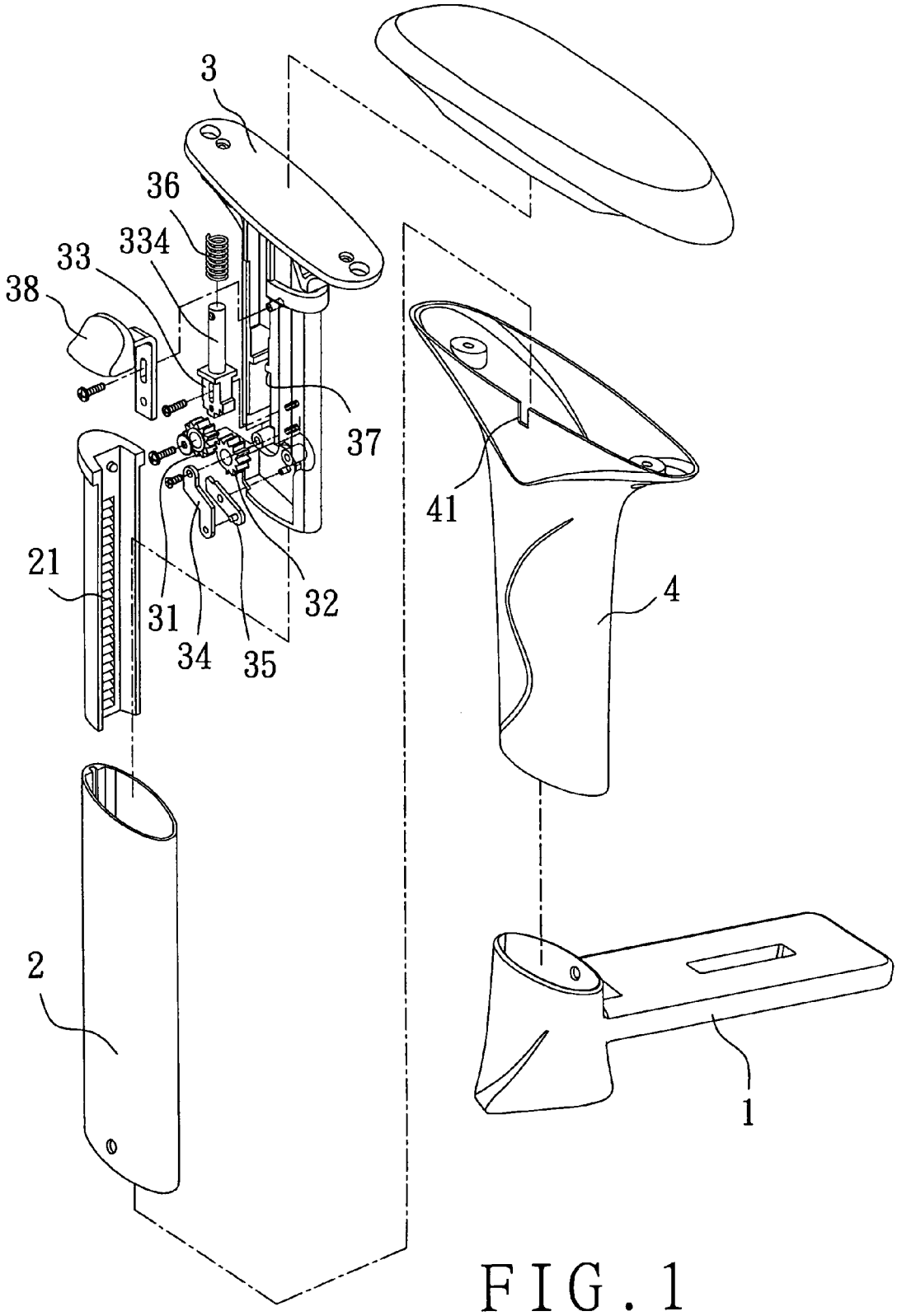
FIG. 1 is an exploded perspective view of the present invention.
Figure 2:
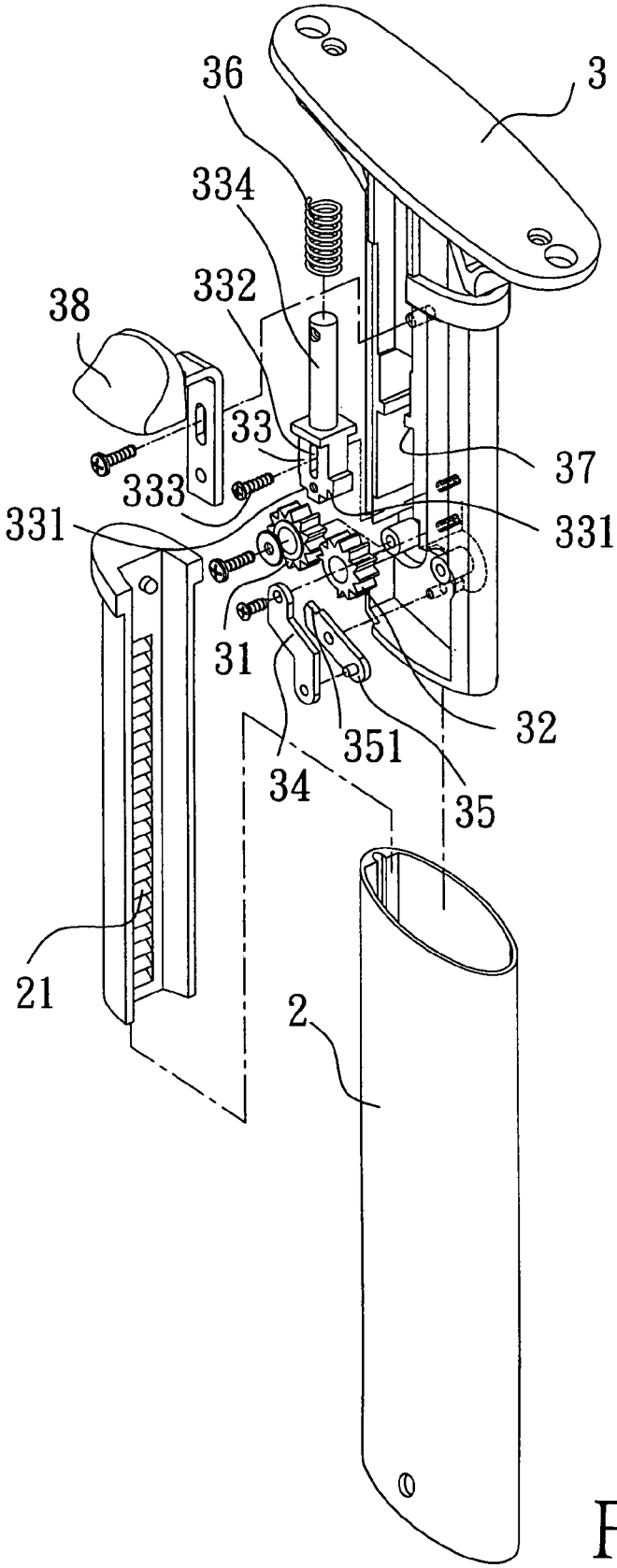
FIG. 2 is a partial exploded perspective view of the present invention.
Figure 3:
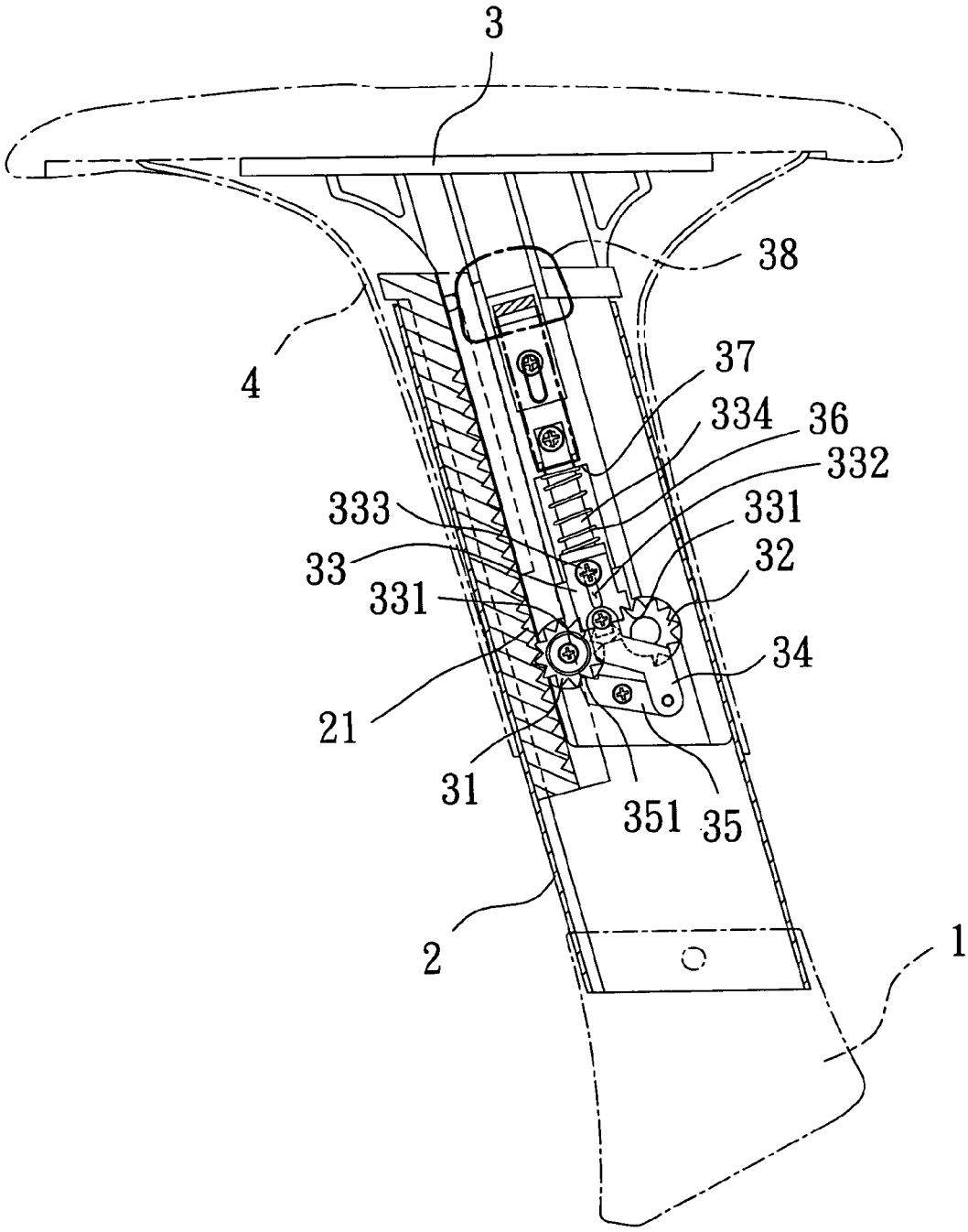
FIG. 3 is a sectional view of the present invention.

Referring to FIG. 1 to FIG. 3, a preferred embodiment of a steplessly height-adjustable armrest of the present invention includes a base, a fixed tube 2, an armrest body 3, and an ornamental shell 4.

The base 1 is securely joined to a seat, and the fixed tube 2 is securely joined to the base 1 in an upright position. The fixed tube 2 has a rack 21 secured therein. The ornamental shell 4 is positioned around and joined to the armrest body 3. The armrest body 3 is inserted in the fixed tube 2 from a lower end thereof with the ornamental shell 4 being around the fixed tube 2 as well as facing the base 1.

The armrest body 3 includes a movable gear 31, which is fitted on the armrest body 3 in a rotatable manner. The armrest body 3 includes an immovable gear 32, which is fitted near to the movable gear 31, and fixed so as not to rotate. The armrest body 3 has an immobilizing component 33 thereon, which can move up and down above the movable gear 31 and the immovable gear 32. The armrest body 3 has a position-limiting protrusion 37 thereon. The immobilizing component 33 has an upper inserted rod portion 334, and is biased downwards by means of an elastic element 36; the elastic element 36 is positioned around the inserted upper inserted rod portion 334, with lower and upper ends thereof contacting the immobilizing component 33 and a lower side of the position-limiting protrusion 37 respectively; thus, the immobilizing component 33 is usually biased to a lower position by means of the elastic element 36. Furthermore, the ornamental shell 4 has a gap 41 thereon. And, the armrest body 3 is equipped with a control member 38, which is passed into the ornamental shell 4 through the gap 41, and joined to an upper end of the upper inserted rod portion 334 of the immobilizing component 33; thus, the immobilizing component 33 can be lifted to a higher position by means of moving the control member 38.

The immobilizing component 33 has an engaging toothed portion 331 on a lower end to engage the movable gear 31 and the immovable gear 32. The immobilizing component 33 has a slot 332 thereon, and is fitted on the armrest body 3 by means of a fixed element 333, which is passed through the slot 332 and fixed to the armrest body 3. A connecting piece 34 is joined to the lower end of the immobilizing component 33 at a first end. A co-moving rod 35 is positioned under the movable gear 31 and the immovable gear 32, and pivoted to a second end of the connecting piece 34 at a first end thereof, and it is further pivoted to the armrest body 3 at a middle portion thereof. The co-moving rod 35 has a position-keeping tooth 351 on a front (second) end thereof to engage the movable gear 31.

Figure 4:
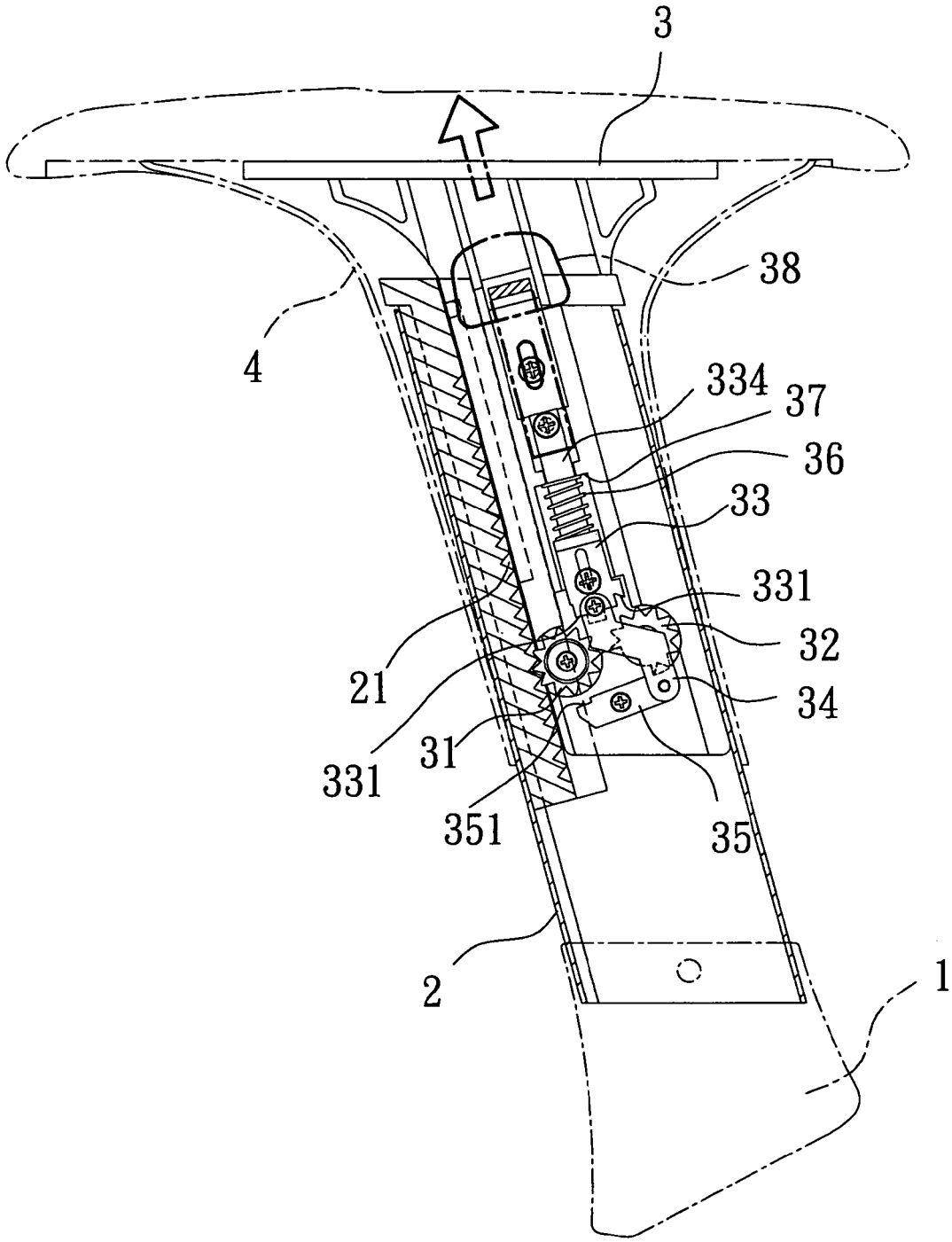
FIG. 4 is a sectional view of the present invention, taken when the armrest is being adjusted in height.
Figure 5:
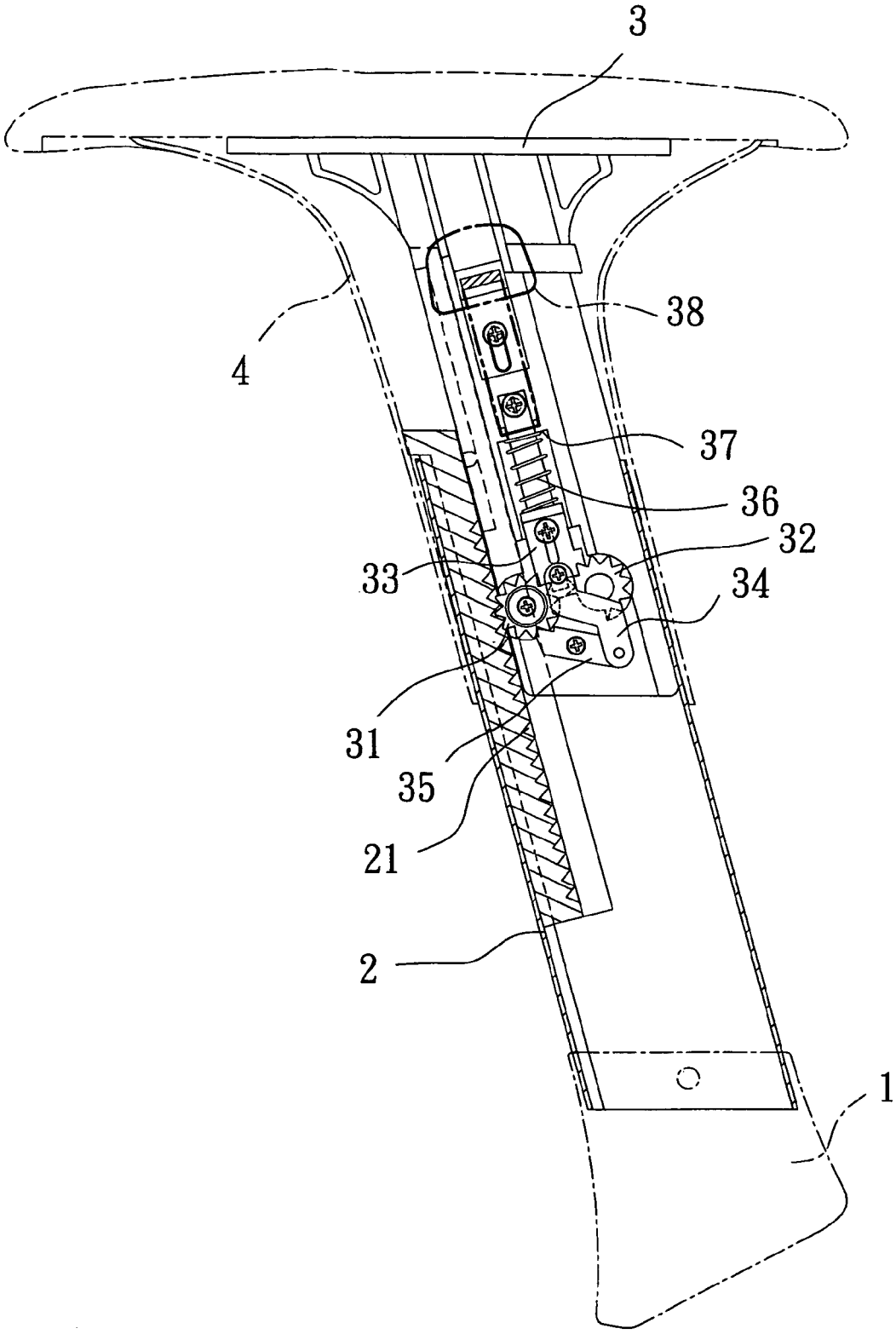
FIG. 5 is a sectional view of the present invention, taken after height adjustment of the armrest.
Figure 6:
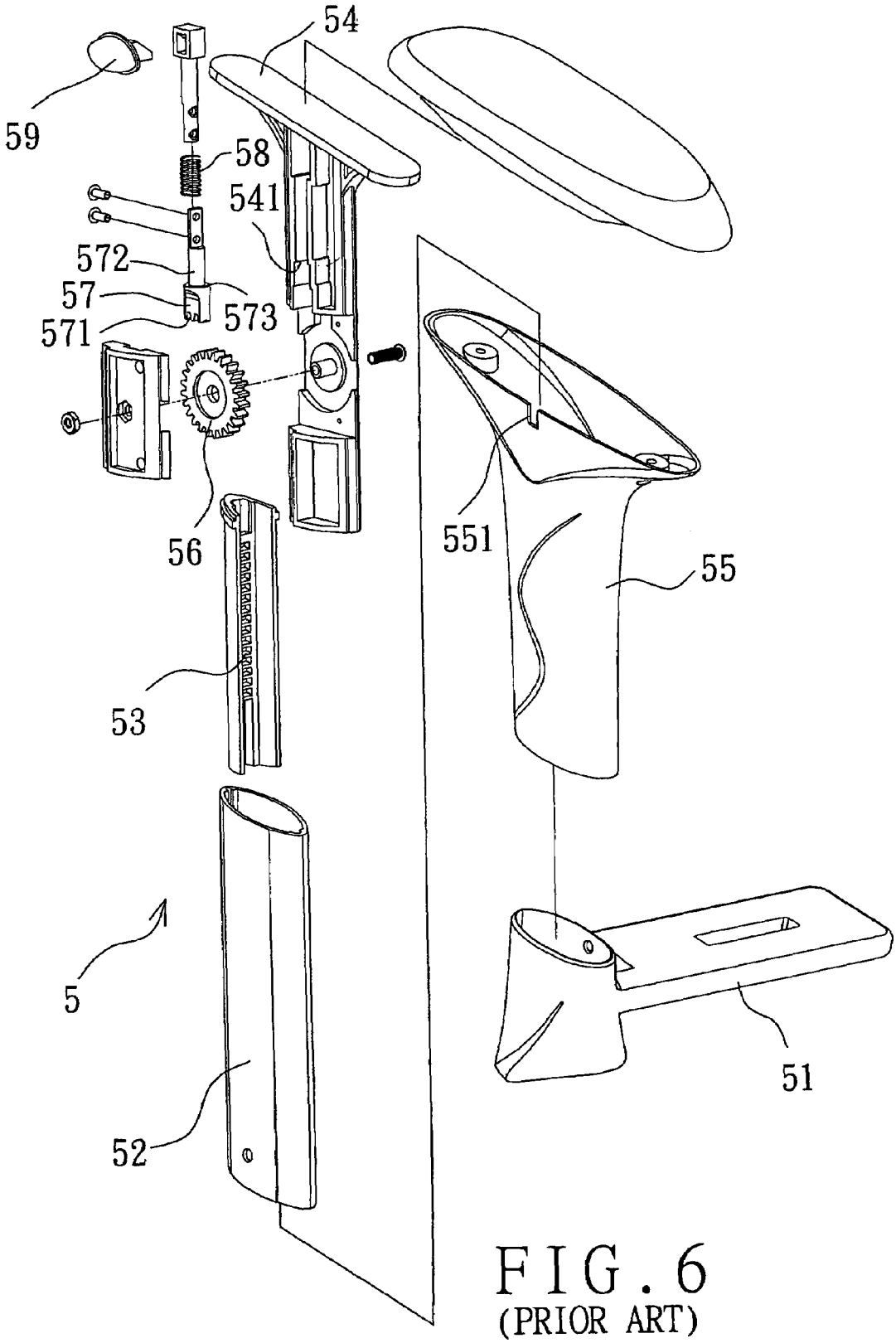
FIG. 6 (PRIOR ART)
FIG. 6 is an exploded perspective view of the prior art.
Figure 7:
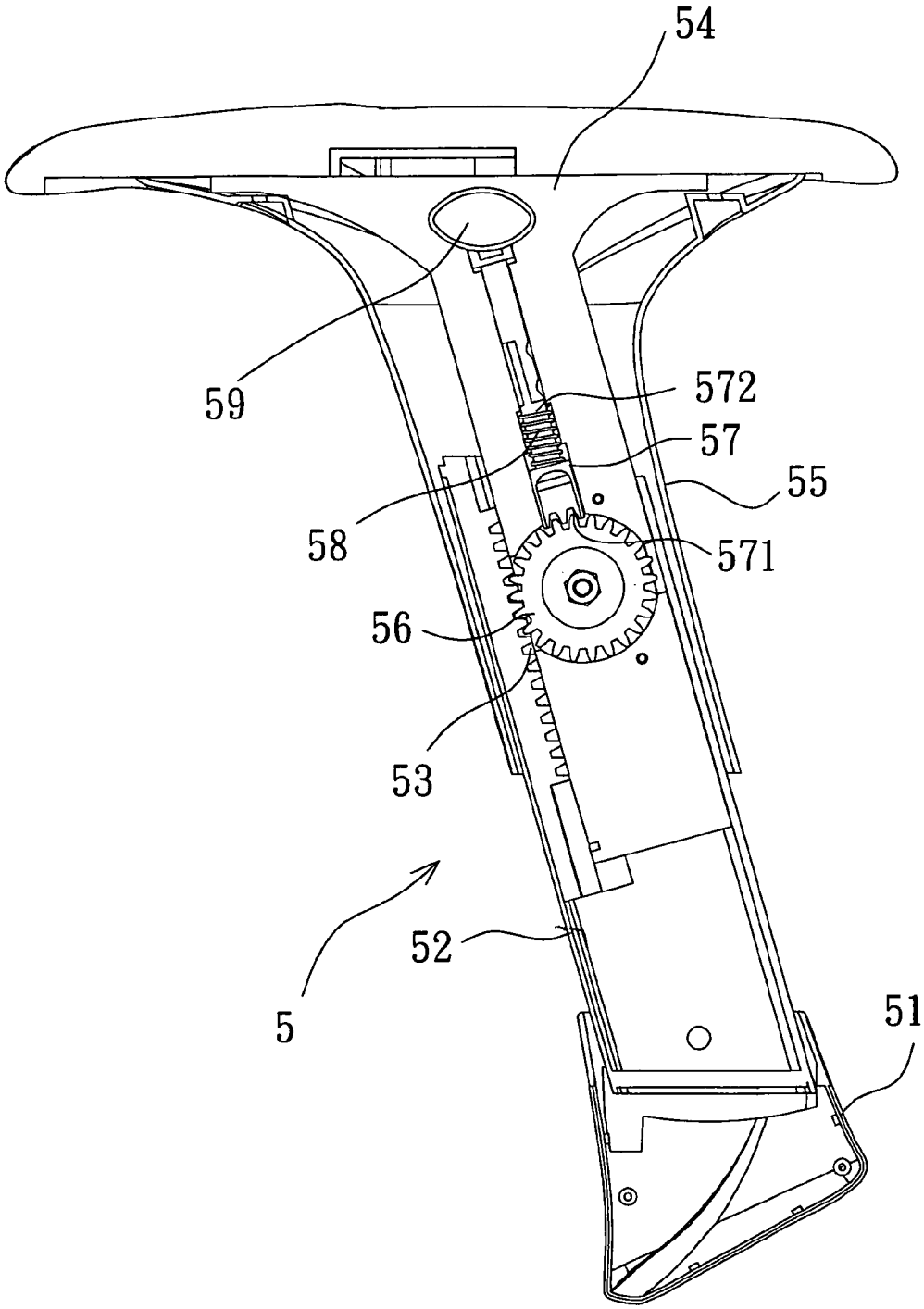
FIG. 7 (PRIOR ART)
FIG. 7 is a sectional view of the prior art.

Referring to FIG. 4, the control member 38 is operated to lift the immobilizing component 33 to the higher position so that the engaging toothed portion 331 of the immobilizing component 33 are off the movable gear 31 and the immovable gear 32, and the connecting piece 34 moves upwards so as to make the co-moving rod 35 pivot on the armrest body 3 with the position-keeping tooth 351 of the front end moving downwards; thus, the co-moving rod 35 no longer engages the movable gear 31 at the position-keeping tooth 351. Consequently, the movable gear 31 is free to rotate, and the armrest body 3 can be moved up and down to adjust the height with the movable gear 31 rolling on the rack 21 secured on the inner side of the fixed tube 2.

After the armrest body 3 has already been moved to a proper height, and the control member 38 released, the immobilizing component 33 will be forced to move back to the lower position by the elastic element 36; thus, the immobilizing component 33 comes into engagement with both the movable gear 31 and the immovable gear 32 at the engaging toothed portion 331 thereof, and the connecting piece 34 moves down together with the immobilizing component 33, and makes the co-moving rod 35 pivot with the position-keeping tooth 351 of the front end moving upwards. Therefore, the position-keeping tooth 351 of the co-moving rod 35 comes back into engagement with the movable gear 31 so that the movable gear 31 is immobilized. Consequently, the armrest body 3 is fixed in position.

From the above description, it can be seen that the armrest of the present invention has an advantage over the prior art: besides having the immobilizing component to engage an upper portion of the movable gear, the present armrest is further equipped with the co-moving rod, which will engage a lower portion of the movable gear at a position-keeping tooth thereof after the armrest has been already adjusted to a new height for use, thus ensuring that the movable gear is immobilized. Therefore, there won't be the risk of the armrest of the present invention being pressed to a lower position accidentally, and the present armrest is more convenient and safer to use.

What is claimed is:

1. A steplessly height-adjustable armrest structure, comprising a base securely joined to a seat;

a fixed tube securely joined to the base, the fixed tube having a rack on an inner side thereof; and an armrest body inserted in the fixed tube;

the armrest body having a movable gear fitted thereon, which engages the rack on the inner side of the fixed tube; the armrest body having an immovable gear fitted thereon, which is near to the movable gear, and fixed so as not to rotate;

the armrest body including an immobilizing component arranged above both the movable gear and the immovable gear; the immobilizing component having a slot thereon; the immobilizing component being fitted on the armrest body by means of a fixed element, which is passed through the slot and fixed to the armrest body;

the immobilizing component having an engaging toothed portion on a lower end thereof; the immobilizing component being movable to a lower position so as to engage both the movable gear and the immovable gear; the immobilizing component being movable to a higher position to be away from the movable gear and the immovable gear; the armrest body having a position-limiting protrusion thereon; the immobilizing component having an upper inserted rod portion; the immobilizing being biased to said lower position by means of an elastic element, which is positioned around the inserted upper inserted rod portion with lower and upper ends thereof contacting the component immobilizing component and a lower side of the position-limiting protrusion respectively;

the armrest body including a control member, which is joined to an upper end of the upper inserted rod portion of the immobilizing component;

the immobilizing component having a connecting piece joined to the lower end thereof; a co-moving rod being positioned under the movable gear and the immovable gear; the co-moving rod being pivoted to the armrest body at a middle portion thereof; the co-moving rod being pivoted to a second end of the connecting piece at one end thereof; the co-moving rod having a position-keeping tooth on other end thereof to engage the movable gear.

2. The steplessly height-adjustable armrest structure as claimed in claim 1, wherein the armrest body has an ornamental shell;

the ornamental shell being around the fixed tube to face the base;

the ornamental shell having a gap thereon;

the control member being passed through the gap of the ornamental shell.

* * * * *